US007147135B2

(12) United States Patent
Le Maner

(10) Patent No.: US 7,147,135 B2
(45) Date of Patent: Dec. 12, 2006

(54) MANUALLY ACTUATED FLUID DISPENSER PUMP

(75) Inventor: Francois Le Maner, Saint Pierre les Elbeuf (FR)

(73) Assignee: Valois SAS, Neubourg (FR)

( * ) Notice: Subject to any disclaimer, the term of this patent is extended or adjusted under 35 U.S.C. 154(b) by 90 days.

(21) Appl. No.: 10/625,549

(22) Filed: Jul. 24, 2003

(65) Prior Publication Data

US 2004/0144805 A1 Jul. 29, 2004

Related U.S. Application Data

(60) Provisional application No. 60/407,961, filed on Sep. 5, 2002.

(30) Foreign Application Priority Data

Jul. 25, 2002 (FR) ..... 02 09425

(51) Int. Cl.
*B67D 5/42* (2006.01)

(52) U.S. Cl. ..... 222/321.9

(58) Field of Classification Search ..... 222/321.1, 222/321.6, 321.7, 321.9
See application file for complete search history.

(56) References Cited

U.S. PATENT DOCUMENTS

| | | | | |
|---|---|---|---|---|
| 5,105,994 | A * | 4/1992 | Jouillat et al. | 222/321.2 |
| 5,192,006 | A * | 3/1993 | Van Brocklin et al. | 222/321.9 |
| 5,738,250 | A | 4/1998 | Gillingham et al. | |
| 5,947,340 | A * | 9/1999 | Arnold et al. | 222/321.9 |
| 6,036,059 | A | 3/2000 | VanBrocklin | |
| 6,050,457 | A | 4/2000 | Arnold et al. | |
| 6,170,713 | B1 * | 1/2001 | Schultz | 222/321.9 |

FOREIGN PATENT DOCUMENTS

EP 0 451 615 A 10/1991

* cited by examiner

*Primary Examiner*—Eric Keasel
(74) *Attorney, Agent, or Firm*—Sughrue Mion, PLLC

(57) ABSTRACT

A manually actuated fluid dispenser pump having a pump body (10), a piston (20) mounted to slide in leaktight manner in the pump body (10) between a rest position and an actuating position, an actuating rod (30) connected, preferably integrally, to the piston (20), and a ferrule (40) fixed to the top edge (11) of the pump body (10) to define the rest position for the piston (20). The actuating rod (30) is mounted to slide in the ferrule (40). The ferrule (40) is provided with at least one internal sealing lip (45) co-operating in leaktight manner with the actuating rod (30).

20 Claims, 2 Drawing Sheets

MANUALLY ACTUATED FLUID DISPENSER PUMP

CROSS REFERENCE TO RELATED APPLICATION

This application claims the benefit under 35 U.S.C. §119 (e) of pending U.S. provisional patent application Ser. No. 60/407,961, filed Sep. 05, 2002, and priority under 35 U.S.C. §119(a)–(d) of French patent application No. FR-02.09425, filed Jul. 25, 2002.

TECHNICAL FIELD

The present invention relates to a manually actuated fluid dispenser pump.

BACKGROUND OF THE INVENTION

In this type of pump, a pump is generally mounted on a reservoir containing the fluid, and is actuated by means of a dispensing head or pusher, assembled onto said pump. The pump generally comprises a pump body in which a piston is mounted to slide between a rest position and an actuating position. The piston is generally connected to an actuating rod adapted to transmit the manual actuation force exerted by the user on the head or pusher. An abutment element, such as a ferrule, is generally assembled in the top edge of the pump body, to define the rest position for said piston. The ferrule generally extends inside the pump body, so that the actuating rod slides inside said ferrule. Sealing between the actuating rod and the pump is generally provided at the piston which is mounted to slide in leaktight manner inside said pump body. The sealing between the pump body, the ferrule, and the fixing ring is generally provided by means of a gasket that is interposed between said pump body and said fixing ring. The coupling between the actuating rod and the ferrule is not necessarily leaktight because sealing is provided by the above-described sealing points. Pumps of the above-described type operate satisfactorily but they suffer from some drawbacks. Thus, when the user exerts an actuating force that is not exactly axial, the actuating rod can be moved off center while it is being actuated, which can give rise to the pump malfunctioning or becoming difficult to actuate. Similarly, since the actuating rod does not necessarily co-operate in leaktight manner with the ferrule, there can be some play between those two elements, so that the actuating rod is not necessarily centered relative to the ferrule and therefore relative to the pump body, which can give rise to the pump malfunctioning while it is being actuated.

BRIEF SUMMARY OF THE INVENTION

An object of the present invention is to provide a fluid dispensing pump that does not suffer from the above-mentioned drawbacks.

In particular, an object of the present invention is to provide a manually actuated fluid dispenser device that guarantees safe and reliable pump operation, even when the actuating force exerted by the user is not exactly axial.

An object of the present invention is also to provide such a pump that improves sealing.

An object of the present invention is also to provide such a pump that is inexpensive to manufacture and to assemble.

The present invention thus provides a manually actuated fluid dispenser pump comprising a pump body, a piston mounted to slide in leaktight manner in said pump body between a rest position and an actuating position, an actuating rod connected, preferably integrally, to said piston, and a ferrule fixed to the top edge of the pump body, to define the rest position for said piston, said actuating rod being mounted to slide in said ferrule, said pump being characterized in that the ferrule is provided with at least one internal sealing lip co-operating in leaktight manner with said actuating rod.

Advantageously, said at least one sealing lip extends over the entire periphery of said ferrule. Advantageously, said at least one sealing lip is made integrally with said ferrule.

Advantageously, said at least one sealing lip is flexible so that leaktightness is guaranteed between itself and said actuating rod, even when the actuating force exerted on the actuating rod is not exactly axial.

Advantageously, said sealing lip of the ferrule centers and/or guides the actuating rod in said ferrule and/or said pump body.

Advantageously, said ferrule is made integrally with a fixing ring organized to fix said pump to a fluid reservoir.

In a first variant, said ferrule is made of a single material.

In a second variant, said ferrule is made of a plurality of materials.

The present invention also provides a fluid dispenser device including a pump as described above.

BRIEF DESCRIPTION OF THE DRAWINGS

Other characteristics and advantages of the present invention appear more clearly from the following detailed description given with reference to the accompanying drawings which are given by way of non-limiting example, and in which.

DETAILED DESCRIPTION

Figure 1:
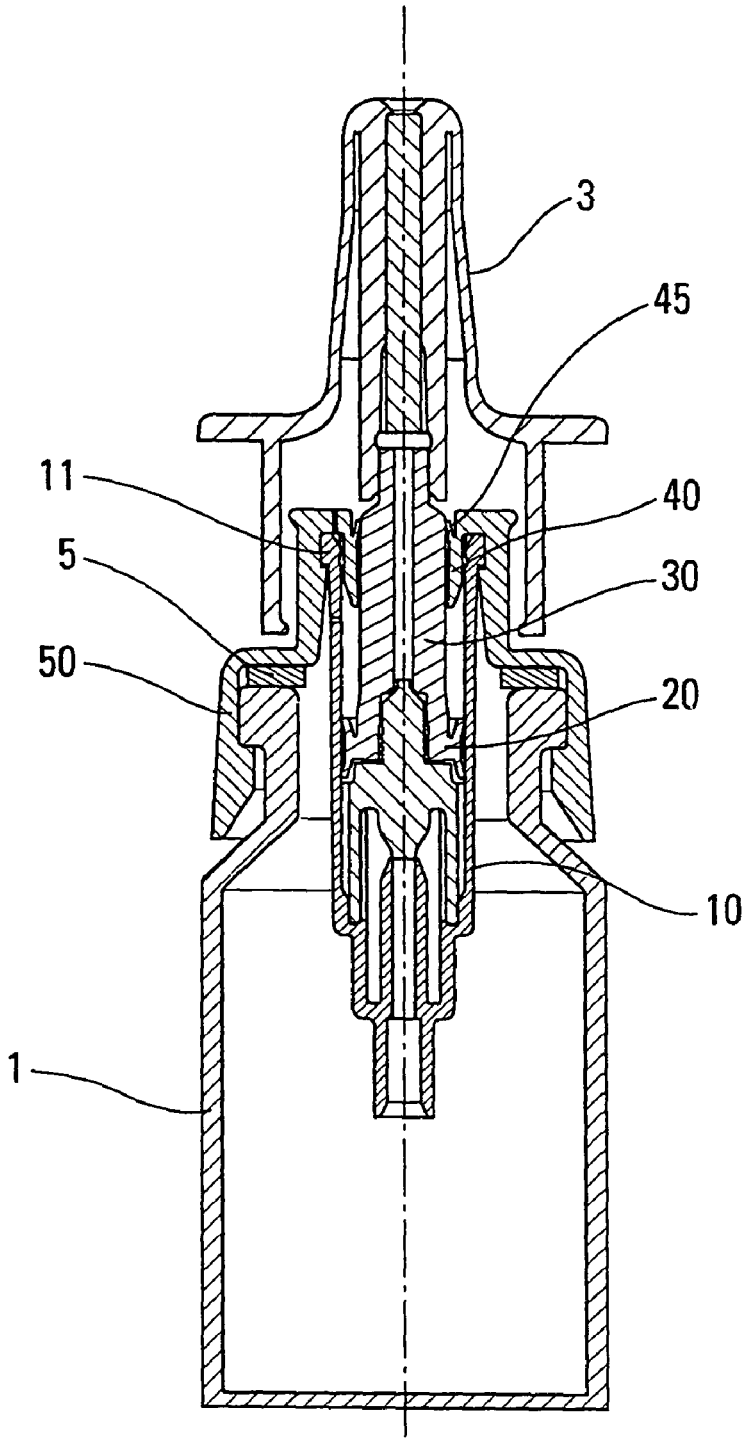
FIG. 1 is a diagrammatic section view of a fluid dispenser device in an advantageous embodiment of the present invention.
Figure 2:
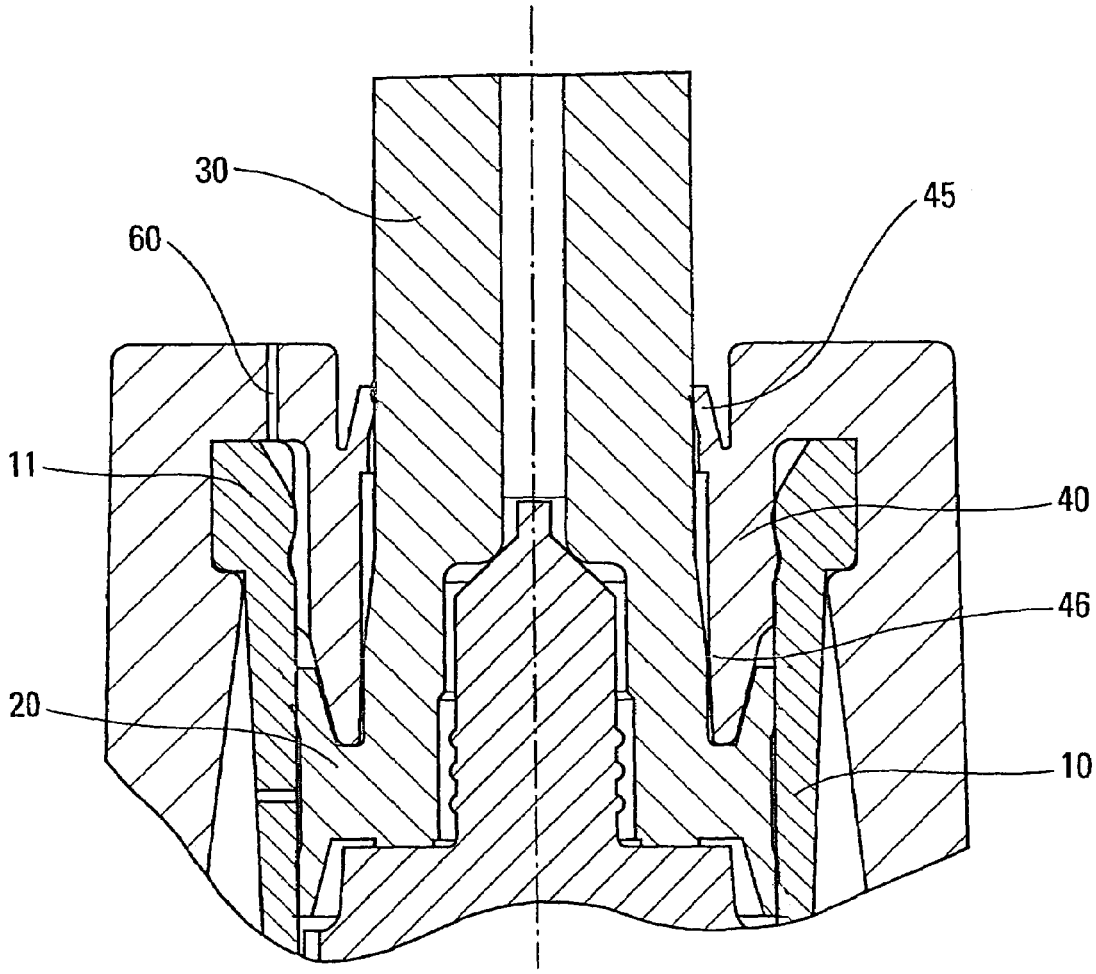
FIG. 2 is a detail view on a larger scale of a portion of the device shown in FIG. 1.

With reference to the figures, the fluid dispenser device includes a reservoir 1 containing a fluid to be dispensed. A pump is mounted in leaktight manner on the reservoir 1 by means of a fixing ring 50 which may be of any type, and in particular screw-fastenable, snap-fastenable, or crimpable. A dispensing head or pusher 3 is assembled onto the pump to actuate it. A user who wishes to use the device exerts an axial force on the pusher 3, which force is transmitted via an actuating rod 30 to a piston 20 which is mounted to slide in leaktight manner inside the pump body 10. Preferably, the pump is a pre-compression pump including a pump chamber that contains the metered quantity or "dose" of fluid to be expelled each time the pump is actuated. In known manner, an abutment element such as a ferrule 40 is fixed to the top edge 11 of the pump body 10 to define the rest position of the piston 20. The ferrule 40 may be force fitted into the pump body 10, or, in a variant, be fixed therein by any other suitable means.

For example, the ferrule may be mounted on the top edge 11 of the pump body, and then a fixing ring 50 is assembled around said top edge of the pump body with a sealing gasket being interposed. The fixing ring 50 is then assembled onto the reservoir 1, generally with a neck gasket 5 being interposed. By way of a variant, the example shown in the figures shows a ferrule made integrally with said fixing ring 50. A venting air passageway 60 may be provided through the one-piece part, and a filter (not shown) for filtering the venting air could be associated with it. In this way, it is possible to reduce the number of component parts, and thus to reduce the costs of manufacturing and assembling the device.

The ferrule 40 advantageously includes a guide portion 46 adapted to guiding the actuating rod 30 as it moves.

In the invention, the ferrule 40 further includes at least one internal sealing lip 45 which preferably extends around the entire periphery of the inside surface of said ferrule 40. The sealing lip 45 is preferably flexible and co-operates in leaktight manner with the actuating rod 30 in all positions of said actuating rod. Preferably, said sealing lip 45 is made integrally with the ferrule 40. The sealing lip 45 makes it inexpensive and simple to provide the following three functions simultaneously:

the coupling between the actuating rod 30 and the ferrule 40 is leaktight in all positions of the pump;

the sealing lip 45 is flexible and exerts a certain amount of radial stress on the actuating rod 30, so that, even when the actuating force is not quite axial, sealing between the actuating rod 30 and the ferrule 40 is maintained by said sealing lip 45 deforming; and the radial stress exerted by the sealing lip 45 on the actuating rod 30 causes said actuating rod to be centered in the pump body and in the ferrule, both in the rest position and also during actuation. The guide portion 46 can also contribute to this centering.

The reliability of the pump is thus improved by eliminating, or at least considerably reducing the risks of said pump malfunctioning or seizing when an actuating force is applied that is not exactly axial.

In the embodiment shown in the figures, in which the ferrule 40 is made integrally with the fixing ring 50, manufacturing and assembly costs are further reduced by reducing the number of component parts.

The ferrule 40 may be made of a single material, or of a plurality of materials. In particular, the sealing lip could be made of a material that is more flexible than the remainder of the ferrule. This allow to provide an optimal flexibility for the sealing lip to ensure good sealing, whilst keeping a good stiffness of the remainder of the ferrule, necessary for the safe operation of the pump. Similarly, when the ferrule 40 is made integrally with the fixing ring, different materials could be used.

In a variant of the embodiment shown, the ferrule could be provided with a plurality of sealing lips that are offset axially. Similarly, the shape and the position of the sealing lip could be different. Thus, although the present invention is described above with reference to a particular embodiment, it should be understood that the person skilled in the art may make any modifications to it without going beyond the ambit of the present invention as defined by the accompanying claims.

The invention claimed is:

1. A manually actuated fluid dispenser pump comprising a pump body (10), a piston (20) mounted to slide in leaktight manner in said pump body (10) between a rest position and an actuating position, an actuating rod (30) that is an integral one-piece construction with the piston, a dispensing head assembled onto the actuating rod, and a ferrule (40) fixed to a top edge (11) of the pump body (10), to define the rest position for said piston (20), said actuating rod (30) being mounted to slide in said ferrule (40), said pump being characterized in that the ferrule (40) is provided with at least one internal sealing lip (45) co-operating in leaktight manner with said actuating rod (30) in all positions of said actuating rod; and wherein a part of the piston abuts against an abutment edge of the ferrule when the piston is in the rest position, said at least one internal sealing lip protruding inwardly from said ferrule and being spaced apart from said abutment edge.

2. A pump according to claim 1, in which said at least one sealing lip (45) extends over the entire periphery of said ferrule (40).

3. A pump according to claim 1, in which said at least one sealing lip (45) is made integrally with said ferrule (40).

4. A pump according to claim 1, in which said at least one sealing lip (45)is flexible so that leaktightness is guaranteed between said at least one sealing lip and said actuating rod (30), even when the actuating force exerted on the actuating rod (30) is not exactly axial.

5. A pump according to claim 1, in which said sealing lip (45) of the ferrule (40) guides the actuating rod (30) in said ferrule (40) or said pump body (10).

6. A pump according to claim 1, in which said ferrule (40) is made integrally with a fixing ring (50) organized to fix said pump to a fluid reservoir (1).

7. A pump according to claim 1, in which said ferrule (40) is made of a single material.

8. A pump according to claim 1, in which said ferrule (40) is made of a plurality of materials.

9. A fluid dispenser device, characterized in that the device includes a pump according to claim 1.

10. The pump according to claim 1, wherein the ferrule defines a cylindrical channel in which the top edge of the pump body is fixed, and wherein the at least one internal sealing lip is radially inward from the channel and extends axially in a direction opposite to the abutment edge of the ferrule.

11. The pump according to claim 1, in which the sealing lip of the ferrule centers and guides the actuating rod in the ferrule and said pump body.

12. A manually actuated fluid dispenser pump, comprising:

a pump body, a piston mounted to slide in leaktight manner in the pump body between a rest position and an actuating position, a rod that actuates the piston from the piston's rest position to the piston's actuating position, wherein the rod is an integral one-piece construction with the piston, and a ferrule at an upper portion of the pump body;

a dispensing head assembled onto the rod; and wherein the actuating rod is mounted to slide within the ferrule;

wherein the ferrule comprises at least one internal sealing lip co-operating in leaktight manner with the actuating rod in all positions of said actuating rod; and wherein a part of the piston abuts against an abutment edge of the ferrule when the piston is in the rest position, such that the ferrule is a stop that prevents further upward axially movement of the piston when the piston is in the rest position, said at least one internal sealing lip protruding inwardly from said ferrule and being spaced apart from said abutment edge.

13. The pump according to claim 12, wherein the ferrule defines a cylindrical channel in which the upper portion of the pump body is seated, and wherein the at least one internal sealing lip is radially inward from the channel and extends axially in a direction opposite to the abutment edge of the ferrule.

14. The pump according to claim 12, wherein the sealing lip extends over an entire periphery of the ferrule.

15. The pump according to claim 12, wherein the sealing lip is an integral one-piece construction with the ferrule.

16. The pump according to claim 12, wherein the sealing lip is flexible so that leaktightness is guaranteed between the sealing lip and the rod when an actuating force exerted on the rod is not exactly axial.

17. The pump according to claim 12, wherein the sealing lip guides the rod in the ferrule.

18. The pump according to claim 12, wherein the ferrule is an integral one-piece construction with a fixing ring that fixes the pump to a fluid reservoir.

19. The pump according to claim 12, wherein the ferrule is made of a single material.

20. The pump according to claim 12, wherein the ferrule is made of a plurality of materials.

* * * * *